US007572744B1

(12) United States Patent
Ikenaga et al.

(10) Patent No.: US 7,572,744 B1
(45) Date of Patent: Aug. 11, 2009

(54) STRETCHABLE HIGH-DENSITY WOVEN FABRIC

(75) Inventors: Hideo Ikenaga, Kyoto (JP); Kunihiko Fukumori, Takatsuki (JP); Mitsuyuki Yamamoto, Kanazawa (JP)

(73) Assignee: Asahi Kasei Kabushiki Kaisha, Osaka-Shi (JP)

( * ) Notice: Subject to any disclaimer, the term of this patent is extended or adjusted under 35 U.S.C. 154(b) by 0 days.

(21) Appl. No.: 10/333,686

(22) PCT Filed: Jul. 25, 2000

(86) PCT No.: PCT/JP00/04951

§ 371 (c)(1),
(2), (4) Date: Jan. 23, 2003

(87) PCT Pub. No.: WO02/08504

PCT Pub. Date: Jan. 31, 2002

(51) Int. Cl.

| | |
|---|---|
| ***D03D 7/00*** | (2006.01) |
| ***D03D 15/00*** | (2006.01) |
| ***D03D 15/08*** | (2006.01) |
| *A41D 3/00* | (2006.01) |
| *A41D 13/00* | (2006.01) |
| *A41D 31/00* | (2006.01) |

(52) U.S. Cl. ..... 442/182; 442/192; 442/195; 442/203; 139/420 R; 139/421; 139/420 A

(58) Field of Classification Search ..... 442/181, 442/182, 185, 203
See application file for complete search history.

(56) References Cited

U.S. PATENT DOCUMENTS

| | | | | |
|---|---|---|---|---|
| 3,658,570 | A * | 4/1972 | Crooks et al. | 427/366 |
| 4,622,253 | A * | 11/1986 | Levy | 428/91 |
| 5,981,409 | A * | 11/1999 | Takagi et al. | 442/203 |
| 6,418,598 | B1 | 7/2002 | Devos | 28/155 |
| 6,607,995 | B1 * | 8/2003 | Takeuchi et al. | 442/216 |

FOREIGN PATENT DOCUMENTS

| | | |
|---|---|---|
| EP | 0 987 358 A1 | 3/2000 |
| EP | 1 059 372 A2 | 12/2000 |
| EP | 1 298 236 A1 | 4/2003 |
| JP | 3-152236 | 6/1991 |
| JP | 5-163632 | 6/1993 |
| JP | 9-170175 | 6/1997 |
| JP | 11-50353 | 2/1999 |
| JP | 11-81141 | 3/1999 |
| JP | 11-200174 | 7/1999 |
| JP | 11-256413 | 9/1999 |
| JP | 2000-160452 | 6/2000 |
| JP | 2000-192352 | 7/2000 |

OTHER PUBLICATIONS

English Translation of JP-292266.*
KoSa to introduce new Corterra Fiber product line business, Jan. 4, 2000, www.kosa.com (3 pages total).*

* cited by examiner

*Primary Examiner*—Jennifer A Chriss
(74) *Attorney, Agent, or Firm*—Finnegan, Henderson, Farabow, Garrett & Dunner, L.L.P.

(57) ABSTRACT

A stretchable high density woven fabric showing a cover factor of from 1,800 to 2,540 and stretchability in terms of a stretch ratio of from 5 to 20% in the warp or weft direction and having a poly(trimethylene terephthalate) fiber at least in the direction in which the woven fabric shows stretchability. The high density woven fabric shows good stretchability and water resistance (water pressure resistance), produces less rustling when contacted with woven fabrics, and provides an excellent soft and comfortable feeling, and it is therefore appropriate for sportswear, outerwear, and the like.

4 Claims, No Drawings

STRETCHABLE HIGH-DENSITY WOVEN FABRIC

TECHNICAL FIELD

The present invention relates to a high density woven fabric providing a soft feeling to the wearer and showing good stretchability and water resistance.

BACKGROUND ART

Woven fabrics prepared by subjecting high density woven fabrics, for which polyamide-based fibers or polyester-based fibers are used, to water-repellent treatment to have water resistance have heretofore been known. The woven fabrics have been widely used for cold-weather clothing such as down jackets, sportswear, outerwear and the like such as windbreakers, blousons, coats and rainwear.

However, because a high density woven fabric in general cannot be elongated, substantially, a wearer's body movement is hindered or the wearer feels pressure when taking exercise. As a result, the wearer cannot freely move, and feels uncomfortable. Moreover, the high density woven fabric provides a stiff feeling due to its high density. Furthermore, because a water-repellent treatment or resin treatment of the woven fabric for giving the fabric water resistance, etc., increases the stiffness of the woven fabric, the woven fabric becomes stiff and bulky when the wearer takes exercise or moves, and this hinders the wearer's free movement or produces a significant rustling when contacted with woven fabrics each other to make the wearer feel uncomfortable.

In order to solve these problems, Japanese Unexamined Patent Publication (Kokai) No. 11-81141 discloses a soft feeling high density woven fabric for which a poly(trimethylene terephthalate) fiber is used as a weft yarn and/or a warp yarn, and which is subjected to resin treatment. Moreover, Japanese Unexamined Patent Publication (Kokai) No. 11-200174 discloses a soft feeling high density woven fabric comprising a poly(trimethylene terephthalate) fiber for which the ratio of a covering ratio of a warp yarn to a covering ratio of a weft yarn and the sum of the covering ratios are defined, and which shows an elastic recovery of 90% or more.

Although the technologies disclosed in these patent publications improve the feeling of the woven fabric and the rustling of woven fabrics by forming the woven fabric from flexible poly(trimethylene terephthalate) fibers, the problem that the woven fabric hinders the body movement of the wearer remains unsolved because the stretchability is insufficient.

Furthermore, Japanese Unexamined Patent Publication (Kokai) No. 9-170175 proposes a woven fabric with improved windbreak performance and water resistance for which an extremely thin multifilament yarn, having a single filament size of 0.5 denier or less and a round-shaped cross section, is used, and in which the sum of cover factors of the warp and weft yarns is made 2,200 or more. Although such a high density woven fabric can have good water resistance, the woven fabric hinders wearer's body movement because the stretchability is insufficient.

On the other hand, Japanese Unexamined Patent Publication (Kokai) No. 11-256413 proposes a lining cloth having stretchability in the weft direction, excellent surface smoothness and a capability of hardly becoming loose at the seams, and showing a significant decrease in pressure on the wearer, because the lining cloth is prepared by using a poly(trimethylene terephthalate) fiber as the weft yarn and the crimp index of the weft yarn is defined.

Although stretchability is imparted to the lining cloth in the weft direction, the lining cloth cannot have good water resistance.

DISCLOSURE OF THE INVENTION

An object of the present invention is to provide a high density woven fabric providing a soft feeling to the wearer and showing good stretchability and water resistance.

In addition, the water resistance referred to in the present invention designates a capability of withstanding water pressure (resistance to water pressure).

As a result of intensively investigating the solution to the above problems, the present inventors have found that the object of the present invention can be achieved by forming a woven fabric from a poly(trimethylene terephthalate) fiber with a specific cover factor, subjecting the woven fabric to special treatment, and specifying the crimp ratio of the fiber, the stretch ratio, fiber filling degree and the like of the woven fabric, and the present invention has thus been achieved.

That is, the present invention is as described below.

1. A stretchable high density woven fabric showing a cover factor of from 1,800 to 2,540 and stretchability in terms of a stretch ratio of from 5 to 20% in the warp or weft direction, and comprising a poly(trimethylene terephthalate) fiber at least in the direction in which the woven fabric shows stretchability.

2. The stretchable high density woven fabric according to 1, wherein the fiber in the direction in which the woven fabric has stretchability shows a CI value (defined below) representing a crimp index of from 0.005 to 0.013, and a DS value (defined below) representing a fiber filling degree of from 0.5 to 1.0:

$$CI = CR/CF_v; \text{ and}$$

$$DS(g/cm^3) = W_s/V_s$$

$$= W_s/\{V \times CF_s/(CF_s + CF_v)\}$$

wherein CR is a crimp ratio of the fiber in the direction in which the woven fabric has stretchability, $CF_v$ is cover factor of a fiber that vertically crosses the fiber in the direction in which the woven fabric has stretchability, $W_s$ is a weight (g) of the fiber, per $m^2$ of the woven fabric, disposed in the stretchable direction of the woven fabric, $V_s$ is an apparent volume ($cm^3$) of the above fiber per $m^2$ of the woven fabric, V is an apparent volume ($cm^3$) per $m^2$ of the woven fabric, and $CF_s$ is a cover factor of the fiber in the direction in which the woven fabric has stretchability.

3. The stretchable high density woven fabric according to 1 or 2, wherein the woven fabric comprises a poly(trimethylene terephthalate) fiber having a flat single filament cross section with a flatness of from 2 to 6 in the direction in which the woven fabric has stretchability.

4. A method for producing the stretchable high density woven fabric according to any one of 1 to 3, comprising the steps of: subjecting the woven gray fabric to dry heat treatment at temperatures of from 150 to 200° C. while the gray fabric is being reduced in width by 10 to 40%; developing crimps in the weft yarn; scouring the fabric; dye finishing the fabric; and calendaring the fabric.

DETAILED DESCRIPTION OF THE INVENTION

The high density woven fabric of the present invention comprises a poly(trimethylene terephthalate) fiber in the direction in which the woven fabric has stretchability.

In the present invention, the poly(trimethylene terephthalate) fiber designates a polyester fiber having trimethylene terephthalate units as principal repeating units, and contains trimethylene terephthalate units in an amount of about 50% by mole or more, preferably 70% by mole or more, more preferably 80% by mole or more and, still more preferably, 90% by mole or more. Accordingly, the poly(trimethylene terephthalate) fiber includes a poly(trimethylene terephthalate) containing as third components other acid components and/or glycol components in a total amount of about 50% by mole or less, preferably 30% by mole or less, more preferably 20% by mole or less, and still more preferably 10% by mole or less.

A poly(trimethylene terephthalate) is synthesized by combining terephthalic acid or a functional derivative thereof, and trimethylene glycol or a functional derivative thereof under suitable reaction conditions in the presence of a catalyst. In the course of the synthesis, a suitable one, or two or more third components, may be added to give a copolymerized polyester. Alternatively, a poly(trimethylene terephthalate), and a polyester other than a poly(trimethylene terephthalate) such as a poly(ethylene terephthalate) may be blended or composed spun (in a sheath-core or side-by-side manner).

Examples of the third component to be added include aliphatic dicarboxylic acids such as oxalic acid and adipic acid, alicyclic dicarboxylic acids such as cyclohexanedicarboxylic acid, aromatic dicarboxylic acids such as isophthalic acid and sodium sulfoisophthalic acid, aliphatic glycols such as ethylene glycol, 1,2-propylene glycol and tetramethylene glycol, alicyclic glycols such as cyclohexanedimethanol, aliphatic glycols containing an aromatic group such as 1,4-bis(β-hydroxyethoxy)benzene, polyether glycols such as poly(ethylene glycol) and poly(propylene glycol), aliphatic oxycarboxylic acids such as ω-oxycaproic acid, and aromatic oxycarboxylic acids such as p-oxybenzoic acid.

Moreover, a compound (such as benzoic acid or glycerin) having one or three or more ester-forming functional groups may also be used as long as the resultant polymer is substantially linear.

Furthermore, the poly(trimethylene terephthalate) may contain delustering agents such as titanium dioxide, stabilizing agents such as phosphoric acid, ultraviolet ray absorbers such as a hydroxybenzophenone derivative, crystallizing nucleus agents such as talc, lubricants such as Aerosil, antioxidants such as a hindered phenol derivative, flame retardants, antistatic agents, pigments, fluorescent brighteners, infrared ray absorbers, defoaming agents, and the like.

The poly(trimethylene terephthalate) fiber used in the present invention can be obtained by, for example, a method wherein an undrawn yarn is wound at a rate of about 1,500 m/min, and the undrawn yarn is drawn and twisted by a factor of from about 2 to 3.5, a direct drawing method (spin-draw method) in which a spinning stage and a drawing and twisting stage are directly connected, a high speed spinning method (spin take-up method) in which the winding rate is 5,000 m/min or more, and the like method.

Furthermore, the shape of the poly(trimethylene terephthalate) fiber may be either a multifilament yarn or a spun yarn. The yarn may be uniform, or vary between thick and thin, in the longitudinal direction. However, a multifilament yarn is preferred. Examples of the shape of the multifilaments yarn include a multifilament raw yarn (including an extremely thin yarn), a soft or hard twisted yarn, a mingled yarn, a false-twisted yarn (including a drawn and false-twisted yarn of POY) and a fluid-jet textured yarn. A multifilaments yarn is preferred in order to more improve the water resistance, and a false-twisted yarn is preferred in order to more improve the stretchability and wearer's comfort.

The size of the poly(trimethylene terephthalate) fiber is preferably 33 dtex or more in order to obtain a sufficient strength of the woven fabric, or preferably 167 dtex or less in order to prevent the woven fabric from becoming thick and rough and stiff. The fiber size is more preferably from 56 to 111 dtex or less. Moreover, the single filament size is preferably 0.1 dtex or more in order to suppress the yarn breakage and improve the spinning stability during spinning, and is preferably 5.6 dtex or less in order to maintain the water resistance of the woven fabric and suppress a rough and stiff feeling. The single filament size is more preferably from 0.56 to 3.3 dtex.

The cross section of the poly(trimethylene terephthalate) filament may be round-shaped, triangle-shaped, L-shaped, T-shaped, Y-shaped, W-shaped, eight leaf-shaped, flat, polygonal (e.g., dog bone-shaped), multi-leaf-shaped, hollow or indefinitely shaped. In order to more improve the stretchability, water resistance and soft feeling of the woven fabric, it is preferred for the single filament to have a flat cross section. When a flat cross section filaments yarn is used, the flat single filaments are stacked properly and filled in the woven fabric, leading to an improvement in the water resistance. Moreover, because a flat cross section yarn shows marked bending flexibility, the yarn tends to bend when other yarns vertically cross it. Elongation of the crimps caused by bending of the flat cross section yarn is effectively utilized, and the stretchability of the woven fabric is increased. The woven fabric simultaneously becomes a soft fabric.

The flat cross section herein designates a flat-shaped cross section of a single filament such as a W-shaped, an I-shaped, a V-shaped, an M-shaped, a dog bone-shaped, an oval-shaped, a wave-shaped or a cocoon-shaped cross section. In view of the improvement of the water resistance, single filaments each having a W-shaped cross section or the like cross section that form a laid bricks shape by piling up and filling the uneven portions of single filaments are preferred.

Furthermore, the flatness of a flat cross section yarn is preferably 2 or more in order to obtain the stretchability, water resistance and soft feeling of the woven fabric, and preferably 6 or less in view of the spinning stability. The flatness herein designates a value obtained by depicting a rectangle circumscribing the cross section of the single filament, and dividing the long side L of the rectangle by the short side H.

In addition, the poly(trimethylene terephthalate) fiber used in the present invention may be blended with other fibers by means such as interlace mingling (a different shrinkage combined filaments yarn prepared with a high shrinkage yarn, etc.), twisted combination, composite false twisting (elongation-differenced false twisting, etc.) and air-jet texturing with two feeds as long as the object of the present invention is not impaired (composite ratio is preferably 60 wt % or less). A fiber to be blended may be any fiber, and blending a synthetic fiber such as a polyester-based fiber, a polyamide-based fiber, a polyacrylonitrile-based fiber, a polyvinyl-based fiber, a polypropylene-based fiber or a polyurethane-based fiber is preferred.

In the present invention, a poly(trimethylene terephthalate) fiber must be used as the warp yarn and/or a weft yarn. However, another fiber may also be mixed and woven. Examples of the fiber that can be mixed and woven include a synthetic fiber such as a polyester-based fiber, a polyamide-based fiber, a polyacrylonitrile-based fiber, a polypropylene-based fiber or a polyurethane-based fiber. Moreover, although a plain weave fabric is most suitable for the weaving structure, a twill fabric, a patterned fabric or a multiple woven fabric may also be used.

The methods of mixed weaving include a method in which a poly(trimethylene terephthalate) fiber is used as a warp yarn or a weft yarn alone, and a method in which a poly(trimethylene terephthalate) fiber and another fiber are doubled as a warp yarn or a weft yarn and mixed woven by alternate feeding of one yarn or two yarns.

The stretchable high density woven fabric of the present invention contains a poly(trimethylene terephthalate) fiber in an amount of preferably 35% by weight or more, more preferably 40% by weight or more, still more preferably 50% by weight or more. The stretchability, water resistance and feeling of the woven fabric can be made good by setting the blending ratio of a poly(trimethylene terephthalate) fiber at 35% by weight or more.

In order for the stretchable high density woven fabric of the present invention to show good stretchability and have good water resistance as well as a good feeling, the cover factor must be made 1,800 or more and 2,540 or less, more preferably from 1,900 to 2,330.

It is preferred that the gray fabric for the high density woven fabric of the invention has a cover factor lower than that of a gray fabric for a conventional high density woven fabric by 10% or more. The above cover factor is preferred for the following reasons. A gray fabric for a conventional high density woven fabric is prepared by weaving a gray fabric in high density so that gaps among weaving yarns are reduced as much as possible to improve the water resistance, and the woven fabric is subjected to finish treatment. However, in the present invention, a gray fabric is made to have a low density to a certain degree, and a high density woven fabric is obtained therefrom by subjecting the gray fabric to the following special treatment: the gray fabric is subjected to a high shrinkage treatment so that the fabric is reduced in width or overfed in the longitudinal direction and gaps among adjacent weaving yarns are reduced.

When the number of arranged warp yarns per 2.54 cm (inch) width and that of arranged weft yarns per 2.54 cm (inch) width are defined as a warp yarn density and a weft yarn density, respectively, the cover factor used herein is given from the following formula:

$$\text{cover factor}=(\text{cover factor of warp yarns})+(\text{cover factor of weft yarns})=(\text{warp yarn density})\times(\text{dtex of warp yarns})^{1/2}+(\text{weft yarn density})\times(\text{dtex of weft yarns})^{1/2}$$

The woven fabric hardly has sufficient water resistance when the cover factor is less than 1,800, and hardly shows good stretchability and provides a rough and stiff feeling when the cover factor exceeds 2,540. In addition, the ratio of a cover factor of warp yarns to a cover factor of weft yarns, namely, (cover factor of warp yarns)/(cover factor of weft yarns), is preferably from 0.7 to 1.7 because the water resistance and stretchability become compatible.

Furthermore, in order to maintain the water resistance of the finished woven fabric and impart stretchability thereto without producing wrinkles, crepes, bowed filling, etc., the gray fabric preferably has a cover factor of from 1,600 to 2,300.

The high density woven fabric in the present invention is characterized in that the stretch ratio in the direction in which a poly(trimethylene terephthalate) fiber is used is from 5 to 20%, preferably from 7 to 17%. When the stretch ratio is less than 5%, the wearer's body movement is hindered or the wearer feels pressure when taking exercise, and the wearer cannot move freely. When the stretch ratio exceeds 20%, the woven fabric is adequately elongated. However, the fibers are excessively bent, and the woven fabric surface comes to have a rough feel; a thickness increase and lowering of water resistance of the woven fabric are unpreferably produced.

In addition, the stretch ratio of a woven fabric herein designates an elongation (%) produced when a sample of the woven fabric is elongated under a stress of 4.9 N/cm using KES-FB1 (trade name, manufactured by KATO TECH Co., Ltd.).

In the present invention, stretchability is imparted to the woven fabric by the following procedure: a woven fabric in the stage of a gray fabric is subjected to high shrinkage treatment such as hot water treatment, wet heat treatment and dry heat treatment to increase fine bends (crimps) of a poly (trimethylene terephthalate) fiber produced by a weaving yarn vertically crossing the poly(trimethylene terephthalate) fiber, and the crimps impart stretchability to the woven fabric. That is, the crimps are obtained by increasing a density difference between the gray fabric density and finished fabric density of the woven fabric; the woven fabric designed in advance to have a coarse density is made to have a high density by subjecting it to high shrinkage treatment in the warp or weft direction to cause a structure shrinkage in addition to a yarn shrinkage, and bends (crimps) with respect to a crossing weaving yarn are manifested and increased.

Because the poly(trimethylene terephthalate) fiber has a small Young's modulus in comparison with a poly(ethylene terephthalate) fiber and a poly(butylene terephthalate) fiber that are typical examples of conventional polyester fibers, it characteristically has marked bending flexibility. The bending flexibility is a major factor of causing the fabric structure to shrink. Use of the poly(trimethylene terephthalate) fiber having marked bending flexibility enables production of a woven gray fabric in which a weft yarn is sufficiently bent with respect to a warp yarn, or a warp yarn is sufficiently bent with respect to a weft yarn. When the gray fabric is subjected to heat treatment that further increases the bent shape, a woven fabric having crimps formed by bends of a weft or warp yarn is prepared, and a significantly high elongation can be manifested by the stretch of the crimps.

In order to obtain adequate stretchability, the high shrinkage treatment is preferably designed so that the finished fabric density is increased by 10% or more in comparison with the gray fabric density of the woven fabric. Moreover, in order to prevent the woven fabric from lowering of the grade caused by the formation of wrinkles and large bowed filling, the high shrinkage treatment is preferably designed so that the finished fabric density is increased by 40% or less in comparison with the gray fabric density of the woven fabric.

One example of the method of the high shrinkage treatment is described below. In order to impart stretchability to the woven fabric in the weft direction, the gray fabric wherein the warp yarn density is coarsely designed, and a poly(trimethylene terephthalate) fiber is used as at least a weft yarn is reduced in width by heat treatment prior to or subsequently to scouring while the fabric is in a stretched state in the warp direction to effect high shrinkage treatment.

Furthermore, in order to impart stretchability to the woven fabric in the warp direction, the woven gray fabric in which a poly(trimethylene terephthalate) fiber is used as, for example, at least a warp yarn is overfed in the longitudinal direction by heat treatment, prior to or subsequent to, scouring while the fabric is in a stretched state in the weft direction to effect high shrinkage treatment.

Heat treatment conditions in the high shrinkage treatment are described below. Dry heat treatment is conducted with an apparatus such as a tenter holding weave edges, a conveyor type net treatment apparatus without holding weave edges (free weave edges) and a drum treatment apparatus. In order to obtain desired stretchability of the woven fabric, use of a pin tenter type dry heat treating machine capable of achieving dimensional control of the woven fabric in the warp and weft directions is preferred. Moreover, the heat treatment temperature is preferably 150° C. or more in order to conduct sufficient shrinkage for achieving desired stretchability, and preferably 200° C. or less in order to prevent the woven fabric from lowering the strength or providing a rough and stiff feeling.

Furthermore, hot water treatment is preferably conducted with such an apparatus showing a significant crumpling effect as a liquid-jet dyeing machine. It is preferred that the treatment temperature is 90° C. or more in view of adequately carrying out shrinkage treatment for achieving desired stretchability, and 140° C. or less in view of conducting the treatment without a special apparatus and without a problem related to the productivity. In addition, when hot water treatment is to be conducted, the woven fabric is preferably subjected to light dry heat presetting at 150° C. or less prior to hot water treatment, because direct hot water treatment of the gray fabric or the woven fabric after scouring forms large wrinkles, crepes or the like due to drastic high shrinkage of the yarns and structure.

In view of the productivity, grade of appearance, properties and the like, the following high shrinkage treatment procedure for imparting stretchability to the woven fabric is preferred: a woven gray fabric in which a poly(trimethylene terephthalate) fiber is used as a weft yarn is subjected to dry heat treatment at temperatures of from 150 to 200° C. with a pin tenter type dry heat treating machine while the gray fabric is being reduced in width by 10 to 40%, whereby weft yarn crimps are manifested; the gray fabric is scoured and finish dyed. Use of the procedure can greatly shrink the structure even when a filaments raw yarn of a poly(trimethylene terephthalate) fiber is used as a weft yarn, and can significantly develop crimps of the weft yarn. Moreover, even when the false-twisted yarn of a poly(trimethylene terephthalate) fiber is used as a weft yarn, formation of crepes caused by excessive crimping development of the false-twisted yarn is suppressed, and good weft yarn crimps caused by the shrinkage of the structure can be developed. In addition, the above treatment procedure makes the stretchability control easy.

Furthermore, in the present invention, scouring is a stage of removing spinning oil, sizing agent on warp yarn and the like sticking to the woven fabric after weaving. An aqueous solution containing alkali, and water or a surfactant is preferred as the treating solution used for the scouring. Although there is no specific limitation on the scouring procedure, the scouring is preferably conducted with such an apparatus commonly used for scouring woven fabrics as an open soaper type continuous scouring machine, a liquid-jet type dyeing machine, a bath suspension type continuous scouring machine, a wince dyeing machine and a softening scouring machine at temperatures of 100° C. or less.

The woven fabric subsequent to heat treatment and scouring is subjected to commonly practiced processing stages such as dyeing and finishing. When the woven fabric is to be made to provide a softer feeling, the fabric may be subjected to alkali reduction prior to dyeing.

In the present invention, the CI value representing a crimp index of a fiber in the direction of a woven fabric in which the woven fabric has stretchability is preferably 0.005 or more in order to obtain sufficient stretchability, and 0.013 or less in order to suppress a rough feeling caused by a rough surface of the woven fabric and significant rustling.

The crimp index is a value calculated by dividing the crimp ratio (CR) of a fiber in the direction in which the woven fabric has stretchability by the cover factor ($CF_v$) of a fiber that vertically crosses the above fiber. The crimp ratio is measured by the following procedure. Two marks 20 cm apart are made on a woven fabric sample (finished woven fabric) in the direction in which the sample has stretchability, and the woven fabric is disintegrated. A fiber in which the woven fabric has stretchability is taken out, and a load of 0.09 g/dtex is applied to the fiber; a mark-to-mark distance L (cm) is measured, and the crimp ratio is calculated from the formula $$\text{crimp ratio}(\%)=\{(L-20)/20\}\times 100$$

Furthermore, in the present invention, the fiber developing crimps and lying in the direction in which the woven fabric has stretchability preferably has a DS value representing a fiber filling degree of from 0.5 to 1.0. When the crimp index is in the above range, the woven fabric shows good stretchability. In order to make both the stretchability and water resistance excellent, the fiber filling degree becomes important. The DS value representing the fiber filling degree is a value calculated by dividing a weight $W_s$ (g) of fibers per $m^2$ of the fabric in the direction in which the woven fabric has stretchability by an apparent volume $V_s$ ($cm^3$) of the above fibers, and signifies the apparent density (filling degree) of fibers having crimps in the woven fabric in the direction in which the woven fabric has stretchability. $V_s$ ($cm^3$) herein is calculated from the following formula:

$$V_s=\{V\times CF_s/(CF_s+CF_v)\}$$

wherein V ($cm^3$) is an apparent volume per $m^2$ of the woven fabric, $CF_s$ is a cover factor of a fiber in the direction in which the woven fabric has stretchability, and $CF_v$ is a cover factor of a fiber that vertically crosses a fiber in the direction in which the woven fabric has stretchability.

In addition, the weight $W_s$ (g) of fibers per $m^2$ of the woven fabric in the direction in which the woven fabric has stretchability is obtained by disintegrating the woven fabric, 10 cm×10 cm, determining the weight of fibers in the direction in which the woven fabric has stretchability, and performing calculation. Moreover, the apparent volume V ($cm^3$) of the woven fabric is calculated by multiplying the thickness (cm) of the woven fabric measured while a load of 0.5 g/$cm^2$ is being applied thereto by an area (10,000 $cm^2$) of 1 $m^2$.

When the DS value representing a fiber filling degree of a fiber in the direction in which the woven fabric has stretchability is less than 0.5, the stretchability becomes significant; however, the water resistance slightly lowers. When the DS value exceeds 1.0, the water resistance becomes good; however, the stretchability becomes unsatisfactory, and the feeling tends to become poor. In order to make the DS value fall in a preferred range, the cover factor of the woven fabric, the shrinkage degree (crimping degree) of the woven fabric structure and the calendaring conditions (pressure, temperature) of the finishing stage should be optimized.

In the present invention, the crimping-imparting effect produced by the flexibility caused by the low Young's modulus the poly(trimethylene terephthalate) fiber has, a suitable cover factor and a suitable fiber filling degree give a woven fabric having desired stretchability and water resistance, and excellent in a soft feeling and a comfortable feeling although it is a high density one.

Furthermore, in the present invention, a waterproof woven fabric having good water repellency and water resistance while maintaining the above properties can be obtained by subjecting the high density woven fabric thus obtained to waterproofing treatment such as water-repellent treatment and pore-filling processing. The woven fabric having been subjected to such processing provides an excellent comfortable feeling to the wearer as a fabric for raincoats, sports windbreakers, and the like. Moreover, because the woven fabric is excellent in down-proofness (capability of preventing a down material filled into winter clothing from getting out of the fabric surface) and has air permeability, the woven fabric provides a comfortable feeling to the wearer when used for cold-weather clothing and down jackets.

"A comfortable feeling to the wearer" used herein refers to a state wherein the woven fabric follows the body movement of the wearer without hindering the body movement when the wearer takes exercise, the woven fabric does not press the wearer, and the wearer can lightly and freely move, and wearer has an agreeable feeling without sensing a stiff touch of the woven fabric and the rustling thereof.

In the waterproofing treatment of the woven fabric obtained in the present invention, examples of usable water repellents include silicone-based, fluoro-based, wax-based, zirconium salt-based, ethyleneurea-based, methylol amide-based and pyridinium salt-based repellents and metal soaps, and there is no specific limitation. However, silicone-based and fluoro-based repellents are preferred in view of the water repelling effects and durability. In addition, crosslinking agents, catalysts, resins and the like may optionally be added to the above water repellents. The woven fabric may be treated with a water repellent by spraying, immersion and squeezing, kiss rolling or the like method.

Furthermore, the pore-filling processing is conducted by pressing the woven fabric subsequent to the treatment with a water repellent, and has the effects of smoothing the woven fabric surface and decreasing gaps among fibers to improve the water resistance, as well as softening the feeling.

The pressing treatment is conducted by pressing the woven fabric between two pairs of rolls, belts, flat plates or the like at room temperature or a high temperature. In view of the processability, pore-filling effect, soft feeling and the like, use of a conventional calendaring machine wherein one roll is a metallic heating roll, and the other roll is a hard cold one prepared from a material such as metal or resin or a medium hard cold one prepared from a material such as rubber or felt is preferred.

The pressing conditions are explained below. The heating roll temperature is preferably from 120 to 200° C., more preferably from 140 to 180° C. The cold roll temperature is preferably 120° C. or less. When the heating roll temperature is less than 120° C., the pore-filling effect becomes insignificant, and adequate water resistance of the woven fabric cannot be obtained. Moreover, when the heating roll temperature exceeds 200° C., the feeling becomes stiff, and the woven fabric becomes paper-like. On the other hand, when the cold roll temperature exceeds 120° C., the feeling becomes stiff, and the woven fabric tends to become paper-like. Moreover, the pressure is preferably from 980 to 3,920 N/cm in terms of a line pressure. When the line pressure is less than 980 N/cm, the pore-filling effect becomes insignificant, and adequate water resistance of the woven fabric cannot be obtained. Still moreover, when the line pressure exceeds 3,920 N/cm, the feeling becomes stiff, and the woven fabric tends to become paper-like.

Furthermore, in the present invention, when the high density woven fabric or the waterproof woven fabric is coated with a resin or a resin is laminated thereto, a permeable waterproof woven fabric having high water resistance and moisture permeability in addition to the above properties can be obtained. The woven fabric is excellent in a comfortable feeling to the wearer for use in sportswear under a severe environment.

In the treating method for obtaining the moisture permeable waterproof woven fabric, a resin such as a polyurethane-based polymer, a polyacryl-based polymer, a polyamide-based polymer, a polyester-based polymer, a poly(vinyl chloride)-based polymer and a polyfluoro-based polymer can be used. In view of the feeling, a polyurethane-based polymer is preferably used. The coating structure of the permeable waterproof woven fabric may be either a microporous coating or a nonporous coating.

A polymer having a hydrophilic group such as —$SO_3H$, $SO_3M$ (M represents an alkali metal or —$NH_4$), —COOM, —COOH, —$NH_2$, —CN, —OH and —$NHCONH_2$ may be used for the nonporous coating. When a coating is formed by dry-solidifying a polymer containing such a hydrophilic group, the hydrophilic group gives moisture permeability to the coating, and the coating makes the woven fabric highly water-resistant because the woven fabric has a nonporous coating.

In order to form a microporous coating as the polymer coating, usable methods include: a method wherein a foaming agent is added to the polymer, and the polymer is foamed after solidification; a method wherein fine particles are added to the polymer, and the fine particles are dissolved and extracted after solidification; and a wet solidification method wherein the polymer is dissolved to form a polymer solution, a coating is formed therefrom, and the solvent is extracted (by replacing the solvent with water, etc.) to form a microporous coating. In view of the uniformity, stability and the like of the coating and micropores, the wet solidification method is preferred.

There is no specific limitation on the method for coating the woven fabric with a resin. However, the woven fabric can in general be coated with a resin using a coater such as a floating knife coater, a knife overroll coater, a reverse roll coater, a roll doctor coater, a gravure roll coater, a kiss roll coater and a nip roll coater.

Furthermore, the laminating method of the above resin can be conducted by, for example, laminating a film of one of the above resins to an adhesive layer applied to the woven fabric in advance and heating the laminated film to be bonded thereto.

Examples of the usable adhesive for bonding the film to the woven fabric include a polyurethane-based polymer, a polyacryl-based polymer, a polyamide-based polymer, a polyester-based polymer, a poly(vinyl chloride)-based polymer and a poly(vinyl acetate)-based polymer. Of these polymers, a polyurethane-based polymer, a polyamide-based polymer and a polyester-based polymer are preferred.

There is no specific limitation on the method for coating the woven fabric with an adhesive. Suitably usable methods include: an entire surface bonding method in which the entire surface of the woven fabric is coated using a coater such as a floating knife coater, a knife overroll coater, a reverse roll coater, a roll doctor coater, a gravure roll coater, a kiss roll coater or a nip roll coater; and a partial bonding method in which the woven fabric is partially coated with an adhesive in a spot-like manner or linearly.

The coating thickness in the coating or laminating method is preferably from 5 to 20 μm in view of the feeling. When the coating thickness is less than 5 μm, a uniform coating thickness is hardly obtained, and the woven fabric cannot have sufficient water resistance sometimes. Moreover, when the coating thickness exceeds 20 μm, the thickness becomes excessively large, and the feeling of the woven fabric tends to become stiff.

As explained above, although the woven fabric of the present invention is a high density one, the crimp-imparting effect produced by the flexibility of the fabric caused by the low Young's modulus the poly(trimethylene terephthalate) fiber has, a suitable cover factor and a suitable fiber filling degree make the woven fabric have good stretchability and water resistance, and provide excellent soft and comfortable feelings to the wearer.

The present invention will be more specifically explained by making reference to examples. However, the present invention is in no way restricted thereto.

In addition, methods for measuring and evaluating the properties of woven fabrics are as explained below, and Table 1 shows the results.

(1) Stretch Ratio (%)

Using KES-FB1 (trade name, manufactured by KATO TECH Co., Ltd.), a woven fabric sample, 20 cm×20 cm, is elongated at a tensile speed of 0.2 mm/sec in the direction in which the sample has stretchability, and the elongation obtained from the following formula is defined as a stretch ratio:

$$\text{elongation}(\%)=(A/20)\times 100$$

wherein A (cm) is an elongated length of the sample when a stress of 4.9 N/cm is applied thereto.

(2) Feeling

A woven fabric is subjected to a sensory test, and the soft feeling is evaluated according to the following criteria with four classes.

◎: very good

○: Good

Δ: Slightly poor

X: Very poor (3) Rustling

A wearer of a woven fabric to be tested runs for 10 minutes, and the woven fabric is tested for rustling (noise) by sensory test, and the results are evaluated according to the following criteria.

◎: Rustling is insignificant, and the woven fabric is good.

○: Rustling is slight, and the woven fabric is good.

Δ: Rustling is slightly significant, and the woven fabric is poor.

X: Rustling is significant, and the woven fabric is very poor.

(4) Air Permeability (cc/cm$^2$/sec)

The air permeability is measured in accordance with JIS L1096 (Method A).

(5) Down-Proofness

Two woven fabric samples each having a size of 17 cm×17 cm are stacked. The three sides are sewn with a sewing margin of 1 cm. Down in an amount of 12 g is placed in a space between the two samples, and the remaining side is also sewn to give a small sized cushion. The small sized cushion is placed in a polyethylene bag, 20 cm×20 cm, and the bag is closed to such a degree that no air enters the bag. The small sized cushion and balls defined below are placed in the box of an ICI pilling tester. The box is rotated under the following conditions, and then the number of down pieces that have pierced out the woven fabric sample is counted.

Balls (large): two rubber balls for softball having a diameter of 61 mm.

Balls (small): two golf balls having a diameter of 42 mm.

Rotating conditions: rotating the box at 60 rpm for 5 hours.

(6) Water Resistance (kPa)

The water resistance of a woven fabric is measured in accordance with JIS L1092 (A method).

PRODUCTION EXAMPLE

A poly(trimethylene terephthalate) fiber used in examples and comparative examples was produced by the following procedure.

An undrawn yarn was prepared at a spinning temperature of 265° C. and a spinning speed of 1,200 m/min from a poly(trimethylene terephthalate) having $\eta_{sp}/c$ of 0.8. The undrawn yarn was then drawn and twisted at a hot roll temperature of 60° C., a hot plate temperature of 140° C., a draw ratio of 3 and a drawing speed of 800 m/min to give a drawn yarn of 56 dtex/36 filaments having a round-shaped cross section. The strength and elongation of the drawn yarn were 2.8 cN/dtex and 46%, respectively.

Similarly, a drawn yarn of 56 dtex/30 filaments having a W-shaped cross section (flatness of 3) was obtained.

In addition, $\eta_{sp}/c$ is determined by the following procedure. A polymer is dissolved in o-chlorophenol at 90° C. at a concentration of 1 g/dl. The solution thus obtained is transferred to an Ostwald viscometer, and measurements are made at 35° C. The $\eta_{sp}/c$ value is calculated from the following formula:

$$\Theta_{sp}/c=[(T/T_0)-1]/c$$

wherein T is a drop time (sec) of the sample solution, T0 is a drop time (sec) of the solvent, and c is a concentration (g/dl) of the solution.

EXAMPLE 1

A poly(trimethylene terephthalate) fiber of 56 dtex/36 filaments having a round-shaped cross section was used as a warp yarn and a weft yarn, and a gray fabric of a plain structure having the following weave densities was obtained: a warp density of 120 ends/2.54 cm; and a weft density of 120 picks/2.54 cm. The gray fabric was heat treated at 200° C. for 30 sec with a dry heat treating machine of pin tenter type while the fabric was being stretched in the warp direction with a reduction in width of 20%.

The reduction in width (%) was calculated from the formula: reduction in width=[{(width of gray fabric)−(width set during reduction in width}/(width of gray fabric)]×100.

The heat treated fabric was desized with a continuous scouring machine, circular dyed at 120° C., dried, and subjected to water-repellent treatment under the following conditions and calendaring.

The woven fabric thus obtained showed stretchability, a soft feeling and good water resistance.

(Water-Repellent Treatment Conditions)

A woven fabric is immersed in an aqueous dispersion containing 6% by weight of Asahiguard LS 317 (manufactured by Asahi Glass Co., Ltd.), 0.3% by weight of Sumitex resin M-3 (manufactured by Sumitomo Chemical Co., Ltd.), 0.03% by weight of Sumitex Accelerator ACX (manufactured by Sumitomo Chemical Co., Ltd.) and 3% by weight of isopropanol, squeezed with rubber rolls and heat treated at 160° C. for 1 minute.

(Calendaring Conditions)

Calendaring is conducted under the following conditions.

Upper roll: a metal roll at 140° C.

Lower roll: a resin roll at 80° C

Line pressure: 2,450 N/cm .

COMPARATIVE EXAMPLE 1

A poly(ethylene terephthalate) fiber of 56 dtex/36 filaments having a round-shaped cross section was used as a warp yarn and a weft yarn, and a gray fabric of plain structure having the following weave densities were obtained: a warp density of 190 ends/2.54 cm and a weft density of 140 picks/2.54 cm. The gray fabric was relaxation scoured, circular dyed at 130° C., and dried. The dried fabric was then subjected to water-repellent treatment and calendaring (except for a metal roll temperature of 180° C.) in the same manner as in Example 1.

The woven fabric thus obtained showed no stretchability, and provided a rough and stiff feeling.

COMPARATIVE EXAMPLE 2

A poly(trimethylene terephthalate) fiber of 56 dtex/36 filaments having a round-shaped cross section was used as a warp yarn and a weft yarn, and a gray fabric of plain structure having the following weave densities were obtained: a warp density of 190 ends/2.54 cm and a weft density of 140 picks/2.54 cm. The gray fabric was relaxation scoured, circular dyed at 130° C., and dried. The dried fabric was then subjected to water-repellent treatment and calendaring under the same conditions as in Comparative Example 1.

The woven fabric thus obtained showed no stretchability, and provided a rough and stiff feeling.

EXAMPLES 2 TO 4, COMPARATIVE EXAMPLES 3 AND 4

Gray fabrics were obtained by repeating the procedure of Example 1 except that the warp density was changed as follows (the same weft density being held): 86 ends/2.54 cm in Comparative Example 3; 100 ends/2.54 cm in Example 2; 148 ends/2.54 cm in Example 3; 172 ends/2.54 cm in Example 4; and 195 ends/2.54 cm in Comparative Example 4.

Each of the gray fabrics was heat treated in the same manner as in Example 1 (reduction in width of 20%) to give a woven fabric having a cover factor differing from those the other gray fabrics, and treated and processed in the same manner as in Example 1.

The woven fabrics thus obtained had the following properties. The woven fabrics in Examples 2 to 4 that were in the range of the present invention showed stretchability, provided a good soft feeling and had good water resistance. On the other hand, the woven fabric in Comparative Example 3 had a low water resistance, and that in Comparative Example 4 showed low stretchability and provided a rough and hard feeling.

EXAMPLES 5 TO 7

The gray fabrics obtained in Example 2 was treated and processed in the same manner as in Example 2 except that the reduction in width during heat treatment was changed as follows to give woven fabrics: 35% in Example 5; 40% in Example 6; and 45% in Example 7.

The woven fabrics thus obtained had the following properties. The woven fabrics in Examples 5, 6 that were in the range of the present invention showed stretchability, provided a soft feeling, and had good water resistance. Moreover, although the woven fabric in Example 7 had good water resistance, wrinkles and yarn bend were formed on the woven fabric surface, and the woven fabric showed somewhat poor quality in comparison with those in Examples 5, 6.

EXAMPLE 8

A false-twisted yarn (false twisting conditions shown below) prepared from a poly(trimethylene terephthalate) fiber of 56 dtex/36 filaments having a round-shaped cross section was used as a warp yarn and a weft yarn, and a gray fabric of a plain structure having the following weave densities was obtained: a warp density of 113 ends/2.54 cm; and a weft density of 113 picks/2.54 cm. The gray fabric was treated and processed in the same manner as in Example 1.

The woven fabric thus obtained showed stretchability, provided a soft feeling, and had good water resistance.

(False Twisting Conditions)

False twisting machine: nip belt type false twisting machine

Yarn speed: 300 m/min

DR: 1.020

OF2: +4.70%

TA: 110°

H1: 160° C.

H2: 160° C.

EXAMPLE 9

A poly(trimethylene terephthalate) fiber of 56 dtex/36 filaments having a round-shaped cross section was used as a warp yarn, and a fluid-jet textured yarn (fluid-jet texturing conditions shown below) prepared from a poly(trimethylene terephthalate) fiber of 56 dtex/36 filaments having round-shaped cross section was used as a weft yarn. A gray fabric of a plain structure having the following weave densities was obtained from the above yarns: a warp density of 110 ends/2.54 cm; and a weft density of 110 picks/2.54 cm. The gray fabric was treated and processed in the same manner as in Example 1.

The woven fabric thus obtained showed stretchability, provided a soft feeling, and had good water resistance.

(Fluid-Jet Texturing Conditions)

Texturing machine: air texturing machine

Yarn speed: 300 m/min

Air pressure: 735 kPa

Overfeed ratio: 15%

Nozzle: Hema Jet TE-312K

EXAMPLE 10, COMPARATIVE EXAMPLE 5

The gray fabric obtained in Example 8 was desized by continuous scouring at 80° C., preset (dry heat treated at 100° C. with the width maintained), and circular dyed at 120° C.

For comparison, the same gray fabric as mentioned above was directly circular dyed at 120° C., and subjected to water-repellent treatment and calendaring in the same manner as in Example 1.

The woven fabric in Example 10 that was in the range of the present invention was stretchable, provided a soft feeling, and had good water resistance. On the other hand, the woven fabric in Comparative Example 5 had large wrinkles formed, became thick, and showed low water resistance.

EXAMPLES 11 AND 12

In Example 11, the same woven fabric having been subjected to water-repellent treatment as in Example 1 was calendared in the same manner as in Example 1 except that the calendaring conditions were changed as follows: a line pressure of 980 N/cm; and a metal roll temperature of 140° C. In Example 12, the same woven fabric having been subjected to water-repellent treatment as in Example 1 was calendared in the same manner as in Example 1 except that the calendaring conditions were changed as follows: a line pressure of 3,430 N/cm; and a metal roll temperature of 170° C.

dtex/30 filaments having a W-shaped cross section with a flatness of 3 was used as a weft yarn; a gray fabric of a plain structure having a warp density of 120 ends/2.54 cm and a weft density of 120 picks/2.54 cm was obtained. The gray fabric thus obtained was treated and processed in the same manner as in Example 1.

The woven fabric thus obtained showed very good stretchability and water resistance, and provided a very good feeling.

TABLE 1

| | Gray | Fabric structure | | | | | |
|---|---|---|---|---|---|---|---|
| | fabric density warp/weft (ends or picks/2.54 cm) | finish density warp/weft (ends or picks/2.54 cm) | Cover factor | Thickness (mm) | Crimp ratio CR (%) | Crimp index CI | Fiber filling degree DS ($g/cm^3$) |
| Ex. 1 | 120/120 | 148/130 | 2080 | 0.12 | 8.2 | 0.007 | 0.61 |
| Ex. 2 | 100/120 | 124/130 | 1901 | 0.11 | 7.6 | 0.008 | 0.61 |
| Ex. 3 | 148/120 | 180/130 | 2320 | 0.13 | 7.2 | 0.005 | 0.63 |
| Ex. 4 | 172/120 | 202/130 | 2484 | 0.13 | 5.9 | 0.004 | 0.67 |
| Ex. 5 | 100/120 | 143/130 | 2043 | 0.12 | 10.4 | 0.01 | 0.60 |
| Ex. 6 | 100/120 | 154/130 | 2125 | 0.12 | 12.3 | 0.011 | 0.63 |
| Ex. 7 | 100/120 | 166/130 | 2215 | 0.12 | 13.9 | 0.011 | 0.65 |
| Ex. 8 | 113/113 | 140/130 | 2020 | 0.11 | 8.9 | 0.008 | 0.65 |
| Ex. 9 | 110/110 | 134/130 | 1976 | 0.11 | 10.2 | 0.01 | 0.64 |
| Ex. 10 | 113/113 | 148/130 | 2275 | 0.13 | 17.8 | 0.014 | 0.62 |
| Ex. 11 | 120/120 | 148/130 | 2080 | 0.15 | 8.8 | 0.008 | 0.49 |
| Ex. 12 | 120/120 | 147/129 | 2065 | 0.07 | 7.2 | 0.007 | 1.04 |
| Ex. 13 | 120/120 | 150/129 | 2073 | 0.11 | 10.5 | 0.009 | 0.67 |
| C. Ex. 1 | 190/140 | 204/146 | 2619 | 0.13 | 1.8 | 0.001 | 0.71 |
| C. Ex. 2 | 190/140 | 220/162 | 2859 | 0.13 | 2.1 | 0.001 | 0.78 |
| C. Ex. 3 | 86/120 | 107/130 | 1774 | 0.11 | 6.2 | 0.008 | 0.57 |
| C. Ex. 4 | 195/120 | 223/130 | 2642 | 0.13 | 3.5 | 0.002 | 0.72 |
| C. Ex. 5 | 113/113 | 200/129 | 2462 | 0.12 | 20.5 | 0.014 | 0.73 |

| | Physical properties of woven fabric | | | | | |
|---|---|---|---|---|---|---|
| | Stretch ratio (%) weft direction | Feeling | Rustling | Down proofness (pieces) | Air permeability ($cc/cm^2 \cdot sec$) | Water resistance pressure (kPa) |
| Ex. 1 | 8.8 | ◎ | ◎ | 0 | 1.9 | 6.8 |
| Ex. 2 | 8.0 | ◎ | ◎ | 3 | 2.1 | 5.2 |
| Ex. 3 | 7.9 | ◎ | ◎ | 0 | 1.3 | 7.4 |
| Ex. 4 | 6.1 | ◎ | ◎ | 0 | 1.1 | 8.2 |
| Ex. 5 | 12.9 | ◎ | ◎ | 1 | 2.0 | 6.6 |
| Ex. 6 | 14.6 | ◎ | ◎ | 1 | 1.8 | 5.0 |
| Ex. 7 | 17.1 | ○ | ○ | 0 | 2.1 | 5.1 |
| Ex. 8 | 10.4 | ◎ | ◎ | 0 | 1.4 | 6.5 |
| Ex. 9 | 12.0 | ◎ | ◎ | 0 | 2.3 | 6.1 |
| Ex. 10 | 19.1 | ◎ | ○ | 2 | 2.6 | 4.9 |
| Ex. 11 | 10.0 | ◎ | ◎ | 2 | 2.4 | 5.1 |
| Ex. 12 | 8.5 | ○ | ○ | 0 | 1.3 | 8.0 |
| Ex. 13 | 13.7 | ◎ | ◎ | 0 | 0.9 | 8.3 |
| C. Ex. 1 | 1.9 | X | X | 0 | 0.4 | 8.9 |
| C. Ex. 2 | 2.4 | X | X | 0 | 0.1 | 8.8 |
| C. Ex. 3 | 7.1 | ○ | ○ | 6 | 2.9 | 3.4 |
| C. Ex. 4 | 4.3 | Δ | Δ | 0 | 0.4 | 9.0 |
| C. Ex. 5 | 24.8 | ○ | X | 4 | 3.3 | 3.8 |

Each of the woven fabrics thus obtained showed stretchability, provided a soft feeling, and had good water resistance. In addition, the woven fabric in Example 11 tended to show slightly lowered water resistance, and the woven fabric in Example 12 tended to provide a slightly poor feeling.

EXAMPLE 13

A poly(trimethylene terephthalate) fiber of 56 dtex/36 filaments having a round-shaped cross section was used as a warp yarn, and a poly(trimethylene terephthalate) fiber of 56

INDUSTRIAL APPLICABILITY

The woven fabric of the present invention is a high density one to which stretchability and water resistance are imparted, which provides a soft feeling and reduces rustling when contacted with woven fabrics each other, and which shows good down proofness. The woven fabric therefore is appropriately used for cold-weather clothing such as windbreakers, blousons, coats, rainwear and down jackets, sportswear, outerwear and the like, and provides a very comfortable feeling to the wearer.

The invention claimed is:

1. A stretchable high density woven fabric comprising a woven fabric satisfying the following conditions (1) to (6):

(1) the woven fabric has a cover factor of from 1,800 to 2,540 and stretchability in terms of a stretch ratio of from 7 to 17% in the warp or weft direction;

(2) the woven fabric has a DS value representing a fiber filling degree of from 0.60 to 1.00;

(3) the woven fabric has a poly(trimethylene terephthalate) fiber at least in the direction in which the woven fabric shows stretchability;

(4) the fiber in the direction in which the woven fabric shows stretchability has a CI value representing a crimp index of from 0.005 to 0.013 wherein:

$$CI = CR/CF_v; \text{ and}$$

$$DS(g/cm^3) = W_s/V_s$$

$$= W_s/\{V \times CF_s/(CF_s + CF_v)\}; \text{ and}$$

wherein CR is a crimp ratio of the fiber in the direction in which the woven fabric has stretchability, $CF_v$ is cover factor of a fiber that vertically crosses the fiber in the direction in which the woven fabric has stretchability, $W_s$ is a weight (g) of the fiber, per $m^2$ of the woven fabric disposed in the stretchable direction of the woven fabric, $V_s$ is an apparent volume ($cm^3$) of the above fiber per $m^2$ of the woven fabric, V is an apparent volume ($cm^3$) per $m^2$ of the woven fabric, and $CF_s$ is a cover factor of the fiber in the direction in which the woven fabric has stretchability;

(5) the woven fabric has a weaving structure of a plain weave fabric or a twill weave fabric; and (6) the woven fabric has a water pressure resistance of from 5.0 to 8.3 kPa.

2. The stretchable high density woven fabric according to claim 1, wherein the woven fabric comprises a poly(trimethylene terephthalate) fiber having a flat single filament cross section with a flatness of from 2 to 6 in the direction in which the woven fabric has stretchability.

3. An article of clothing comprising sportswear, cold-weather clothing and outerwear made from the stretchable high density woven fabric according to claim 1.

4. The article of clothing according to claim 3, wherein the woven fabric comprises a poly(trimethylene terephthalate) fiber having a flat single filament cross section with a flatness of from 2 to 6 in the direction in which the woven fabric has stretchability.

* * * * *